US007285921B2

(12) United States Patent
Chen

(10) Patent No.: US 7,285,921 B2
(45) Date of Patent: Oct. 23, 2007

(54) ELECTRIC CURRENT BALANCING DEVICE

(75) Inventor: Mender Chen, Taoyuan (TW)

(73) Assignee: Taipei Multipower Electronics Co., Ltd., Lungtan, Taoyuan (TW)

( * ) Notice: Subject to any disclaimer, the term of this patent is extended or adjusted under 35 U.S.C. 154(b) by 0 days.

(21) Appl. No.: 11/324,938

(22) Filed: Jan. 4, 2006

(65) Prior Publication Data

US 2007/0152607 A1 Jul. 5, 2007

(51) Int. Cl.
*H05B 37/02* (2006.01)

(52) U.S. Cl. ..... 315/291; 315/277; 315/282; 315/312

(58) Field of Classification Search ..... 315/57, 315/70, 224–226, 276, 277, 282, 291, 307
See application file for complete search history.

(56) References Cited

U.S. PATENT DOCUMENTS 6,856,099 B2 2/2005 Chen et al. ..... 315/224
6,936,975 B2 * 8/2005 Lin et al. ..... 315/224
2006/0022610 A1 * 2/2006 Ball ..... 315/213
2006/0158124 A1 * 7/2006 Hosaka et al. ..... 315/82
2006/0284568 A1 * 12/2006 Chang et al. ..... 315/282
2007/0001622 A1 * 1/2007 Chan et al. ..... 315/282

* cited by examiner

*Primary Examiner*—Douglas W. Owens
*Assistant Examiner*—Ephrem Alemu
(74) *Attorney, Agent, or Firm*—Charles E. Baxley

(57) ABSTRACT

An electric current balancing device includes an inverting circuit having a driving unit and one or more transformers coupled together for outputting an electric current to a load device, a detecting circuit coupled to the inverting circuit for receiving and detecting an electric current of the load device and for stabilizing and sending a stabilized and calibrated electric current to the inverting circuit, and a balancing transformer device having a primary side coupled to the inverting circuit for receiving the calibrated electric current from the inverting circuit, and a secondary side coupled to the load device for comparing an electric current of the load device with the calibrated electric current from the inverting circuit and for controlling the load device.

5 Claims, 16 Drawing Sheets

ELECTRIC CURRENT BALANCING DEVICE

BACKGROUND OF THE INVENTION

1. Field of the Invention

The present invention relates to an electric current balancing device, and more particularly to an electric current balancing device for coupling to a multi-loaded electric facility and for comparing the electric current of each load with a steady and calibrated or regulated or standard electric current, and for providing a stable and balancing electric current to suitably energize the loads of the multi-loaded electric facility.

2. Description of the Prior Art

Typical multi-loaded electric facilities, such as the typical liquid crystal display (LCD) light devices or display panels may comprise various kinds of discharge lamps, such as cold cathode fluorescent lamps (CCFL) as the backlight source for the display panels, and employ network to drive the discharge lamps.

In larger LCD display panels, a number of lamps or light tubes are required to be provided and installed for providing the required brightness. When a number of lamps are installed in the larger LCD display panels, a single transformer or driving or actuating circuit is not so effective on performance to actuate or drive two or more discharge lamps that are coupled parallel with each other.

For example, the impedances of the discharge lamps may be different from each other, and may seriously influence the flowing of the electricity through the discharge lamps; i.e., the electricity may not be evenly flown through the discharge lamps, such that the discharge lamps may not be suitably driven or actuated or energized.

When the electric current is less than the required amount, the discharge lamps may not be suitably driven or actuated or energized to the required brightness, and the brightness in different portions or areas of the larger LCD display panels may be different from each other, and may seriously decrease the uniformity of the display panels.

On the contrary, when the electric current is greater than the predetermined amount, the discharge lamps may be over-energized and the working life of the discharge lamps may be greatly decreased. In addition, the characteristics of the discharge lamps may be changed any time, such that the electricity may not be used to evenly energize various discharge lamps.

For example, the diameters of different discharge lamps may be different from each other, the mercury densities and/or the electrodes of different discharge lamps may also be different from each other, the pressures of different discharge lamps may also be different from each other, such that the impedances of the discharge lamps may be different from each other, and such that different discharge lamps may not be evenly energized by the typical driving or actuating circuits, and such that the discharge lamps of the typical LCD display panels may normally generate flashes and/or flickers that people may not be easily conscious of and that may hurt people or may easily fatigue people or users.

For allowing the lamps or light tubes to be suitably driven by the transformer or driving or actuating circuit, the applicant has developed a multi-lamp actuating facility for evenly and uniformly driving or actuating a number of light tubes or lamps of such as liquid crystal display (LCD) light devices or display panels or other multi-loaded electric facilities.

For example, U.S. Pat. No. 6,856,099 to Chen et al. discloses one of typical multi-lamp actuating facilities arranged for allowing the lamps or light tubes to be suitably driven by the transformer or driving or actuating circuit. However, the light tubes or lamps may include different characters, such as lengths, outer diameters, mercury densities, pressures, electrode appliances, etc. which may affect the energizing or operating of the light tubes or lamps, such that the light tubes or lamps may not be actuated or operated in the best operating modes or status.

The present invention has arisen to mitigate and/or obviate the afore-described disadvantages of the conventional actuating devices for multi-loaded facilities.

SUMMARY OF THE INVENTION

The primary objective of the present invention is to provide an electric current balancing device for coupling to a multi-loaded electric facility and for comparing the electric current of each load with a steady and calibrated or regulated or standard electric current, and for providing a stable and balancing electric current to suitably energize the loads of the multi-loaded electric facility.

In accordance with one aspect of the invention, there is provided an electric current balancing device comprising a load device, an inverting circuit including a driving unit and at least one transformer coupled together for outputting an electric current to the load device, a detecting circuit coupled to the inverting circuit, the detecting circuit being provided for receiving and detecting an electric current of the load device and for stabilizing and providing a stabilized and calibrated electric current to the inverting circuit, and a balancing transformer device including a primary side coupled to the inverting circuit for receiving the calibrated electric current from the inverting circuit, and including a secondary side coupled to the load device for comparing an electric current of the load device with the calibrated electric current from the inverting circuit and for controlling the load device.

The balancing transformer device may be selectively coupled between the primary side of the transformer and the driving unit of the inverting circuit.

The load device may include one or more light devices, such as cold cathode fluorescent lamps, light tubes, light emitting diodes, or other light devices, or the load device may either be a single phase, a double phase, or a multi-phase voltage regulator module (VRM).

The balancing transformer device may also include at least two coils coupled together at the secondary side of the balancing transformer device for forming a twins structure, a triplet structure or the like.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
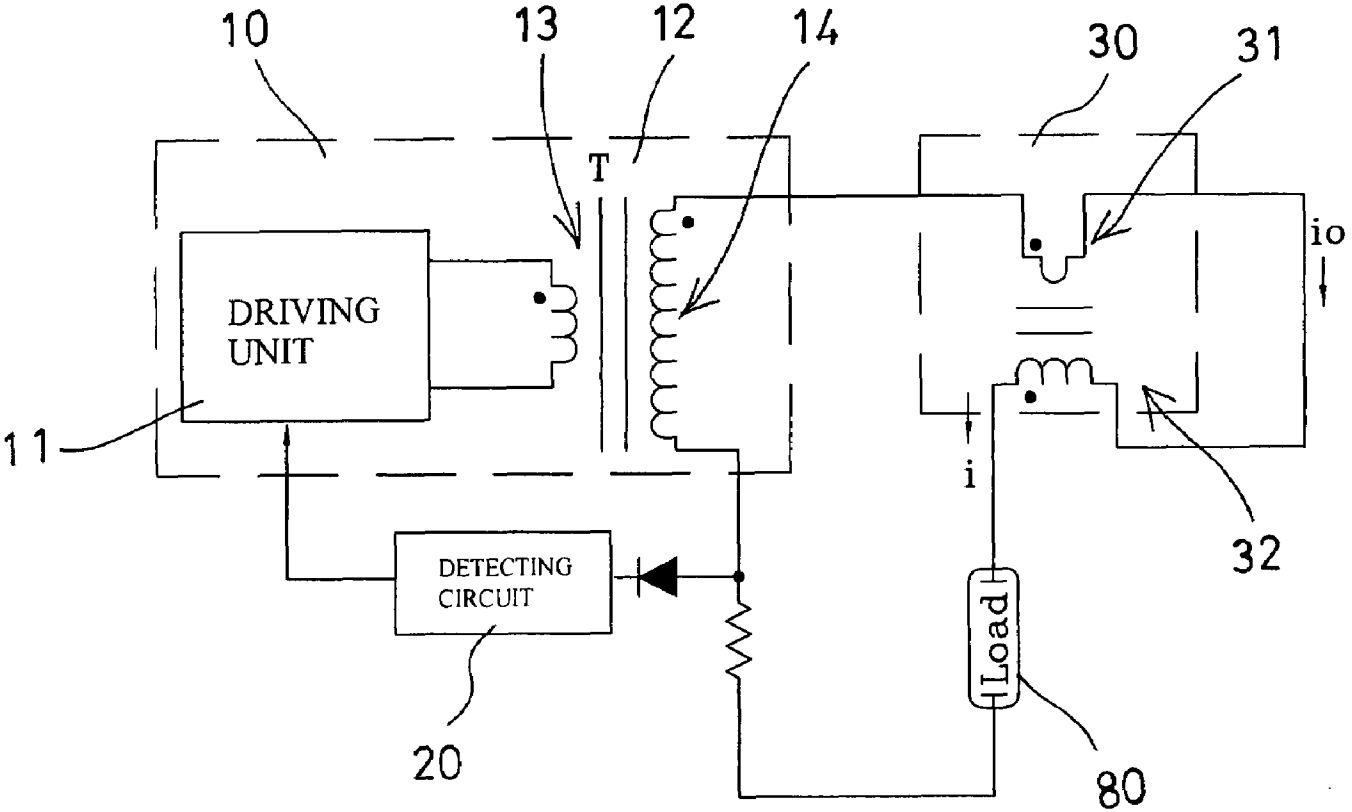
FIG. 1 is a plan schematic view illustrating a general construction of an electric current balancing device in accordance with the present invention.

Referring to the drawings, and initially to FIG. 1, an electric current balancing device in accordance with the present invention comprises an inverting circuit 10, a detecting circuit 20, and a balancing transformer device 30 for coupling to a multi-loaded electric facility or load device 80, such as an LCD display panel 80 which includes one or more loads or load members, such as cold cathode fluorescent lamps, light tubes, light emitting diodes, or other light devices, multi-phase DC-DC converters, etc., and for providing a stable and balancing electric current to suitably energize the loads of the multi-loaded electric facility or load device 80.

The inverting circuit 10 includes a power circuit or device or driving unit 11 and one or more transformers T or 12 for coupling to and for providing the electric power or current to energize the multi-loaded electric facility or load device 80. The detecting circuit 20 is coupled to the input terminal of the inverting circuit 10 and coupled to a detecting point or low voltage side of the multi-loaded electric facility or load device 80, for receiving and detecting the electric current of the multi-loaded or load device 80 and then, feedbacks to the input terminal of the inverting circuit 10 for stabilizing and for providing a stable electric power or current to energize the multi-loaded or load device 80.

The transformer T or 12 includes a primary side 13 coupled to the driving unit 11, and a secondary side 14 coupled to the multi-loaded or load device 80 and the balancing transformer device 30. The balancing transformer device 30 includes a primary side 31 coupled to output terminal or the transformer T or 12 of the inverting circuit 10 for receiving the stabilized electric power or current from the inverting circuit 10, and includes a secondary side 32 coupled to the multi-loaded or load device 80 for suitably energizing or actuating the loads or load members of the load device 80.

In accordance with Maxwell-Faraday's and Maxwell-Ampere's Lows on Electro-Magnetic Power Conversion, we have $$\nabla\times\vec{E}=-\dot{\vec{B}}\ \&\ \nabla\times\vec{H}=\vec{J}+\dot{\vec{D}}$$

in which E: electric field strength or intensity,

B: magnetic flux strength or intensity,

H: magnetic field strength or intensity,

J: electric current frnsity,

D: electric flux strength or intensity.

For a stationary closed path C, we have $\dot{\vec{D}}=0\Rightarrow\nabla\times\vec{H}=\vec{J}$, and by Stokes' theorem for space vector analysis, it shows:

$$\int_A\nabla\times\vec{A}\cdot d\vec{s}=\oint_C\vec{A}\cdot d\vec{l}$$

$$\Rightarrow\int_A\nabla\times\vec{E}\cdot d\vec{s}=\oint_C\vec{E}\cdot d\vec{l}=-\int_A\dot{\vec{B}}\cdot d\vec{s}\ \&$$

$$\int_A\nabla\times\vec{H}\cdot d\vec{s}=\oint_C\vec{H}\cdot d\vec{l}=\int_A\vec{J}\cdot d\vec{s}$$

In the present electric current balancing device, a ferrite core of an isotropic characteristic is used, and we get the electro-motive force (emf) and the magneto-motive force (mmf) as below:

$$\text{emf}=V=\oint_C\vec{E}\cdot d\vec{l}=\int_A\nabla\times\vec{E}\cdot d\vec{s}=-\int_A\dot{\vec{B}}\cdot d\vec{s}=-nAdB/dt=-nd\phi/dt,$$

$$\text{and mmf}=Hl=\oint_C\vec{H}\cdot d\vec{l}=\int_A\nabla\times\vec{H}\cdot d\vec{s}=\int_A\vec{J}\cdot d\vec{s}=\Sigma ni$$

$$\Rightarrow H=\Sigma ni/l,\ \text{and}\ B=\mu H=\mu\Sigma ni/l$$

So we have $$V_s=-n_sAdB/dt=-n_sAd(\mu\Sigma ni/l)/dt=-(\mu n_sA/l)d(n_si_s-n_pi_p)/dt$$

and in the present electric current balancing device, $i_p$ is fixed or has been calibrated into stable current, such that $$V_s=-(\mu n_sA/l)d(n_si_s)/dt=-\mu n_s^2A/l\cdot di_s/dt=-L_sdi_s/dt$$

in which $\phi$: magnetic flux in the ferrite core,

L: inductance, $\mu$: magnetic permeability.

Accordingly, in case of any unbalance of current existed between the secondary side 32 and the primary side 31 of the balancing transformer device 30, a back emf of $V_s$ is going to be induced in proportional to the variation of secondary side current ($di_s/dt$) and is amplified also by the secondary inductance ($L_s$), and is applied upon the load device 80 that is coupled to the secondary side 32 of the balancing transformer device 30, the electric current in the secondary side 32 of the balancing transformer device 30 may thus be enforces or balanced or corrected and will then be equally matched with that in the primary side 31 of the balancing transformer device 30.

When balanced: (i.e., $n_si_s=n_pi_p$)

$$\Rightarrow H=n_si_s-n_pi_p=0\ \&\ B=\mu H=0$$

$$\Rightarrow V_s=0$$

The balancing device will thus work like a simple electric current transformer only, and the electric current conducted at each side of the balancing transformer device 30 shall be exactly inverse proportional to its turn ratio, and there will be no back emf induced and imposed on any side of the balancing transformer device 30 and/or the multi-loaded electric facility or load device 80.

When unbalanced: (i.e., $n_s i_s \neq n_p i_p$)

$$\Rightarrow V_s = -L_s di_s/dt$$

That is, once there's any unbalance condition happened, no mater it is caused by the variation of load or the voltage source, a transient corrective force of back emf=$V_s=-L_s di_s/dt$ will be induced on the secondary side 32 of the balancing transformer device 30 and the electric current at the secondary side 32 of the balancing transformer device 30 will be adjusted according, until reaching the balance condition: $n_s i_s = n_p i_p$.

Accordingly, as shown in FIG. 1, when the electric current balancing device is operated, the detecting circuit 20 may receive and detect the electric current (io) from the multi-loaded electric facility or load device 80 and may stabilize the electric current and then feed the electric current back to the input terminal of the inverting circuit 10, for allowing the electric current balancing device to output a calibrated and stabilized electric current to the balancing transformer device 30 and then to the multi-loaded electric facility or load device 80.

Under the application of Lenz's Law, when the electric current at the secondary side 32 of the balancing transformer device 30 or at or through the load device 80 is varied or changed, a back emf will be induced or generated on the secondary side 32 of the balancing transformer device 30 or at the load device 80 and will be compared or matched with the calibrated or stabilized electric current at the primary side 31 of the balancing transformer device 30, in order to avoid or to prevent the electric current at the secondary side 32 of the balancing transformer device 30 or at the load device 80 from being varied or changed, and thus for allowing the load device 80 to be stably worked or energized by the calibrated or stabilized electric current.

Referring next to FIGS. 2-7, illustrated are various applications of the electric current balancing device, in which the balancing transformer members CBk of the balancing transformer device 30 are indicated or represented by CB1, CB2, . . . CBk, the winding turns in the primary side 31 and the secondary side 32 of the balancing transformer device 30 are indicated or represented by nk1 and nk2 respectively, the electric current is indicated or represented by ik, the capacitor is indicated or represented by Ck, the conventional balancing transformer members of or in the load device 80 is indicated or represented by BTk, and the load members of the load device 80 is indicated or represented by Loadk.

For example, in FIGS. 2-7, the balancing transformer device 30 may be coupled to the secondary side 14 of the transformer T or 12 of the inverting circuit 10, and the balancing transformer members CBk of the balancing transformer device 30 are arranged or coupled in parallel to each other and coupled to the high voltage side of the load device 80 (FIGS. 2-6) or coupled to the low voltage side of the load device 80 (FIG. 7), for allowing the output calibrated and stabilized electric current from the inverting circuit 10 to evenly flow to the load members Loadk of the load device 80, in order to suitably control and balance the electric current supplied to the load members Loadk of the load device 80.

Figure 2:
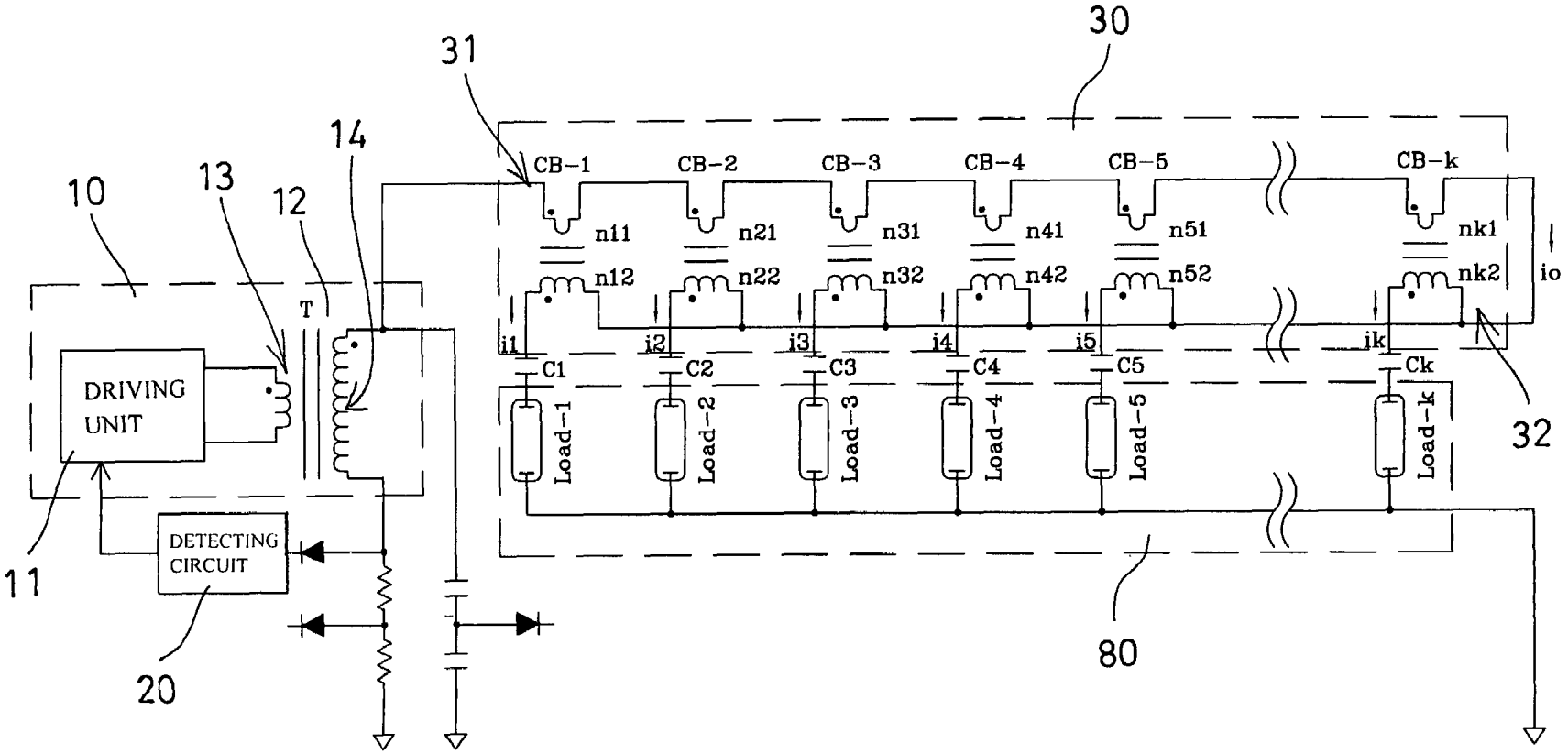
FIG. 2 is a plan schematic view illustrating an application of the electric current balancing device.
Figure 6:
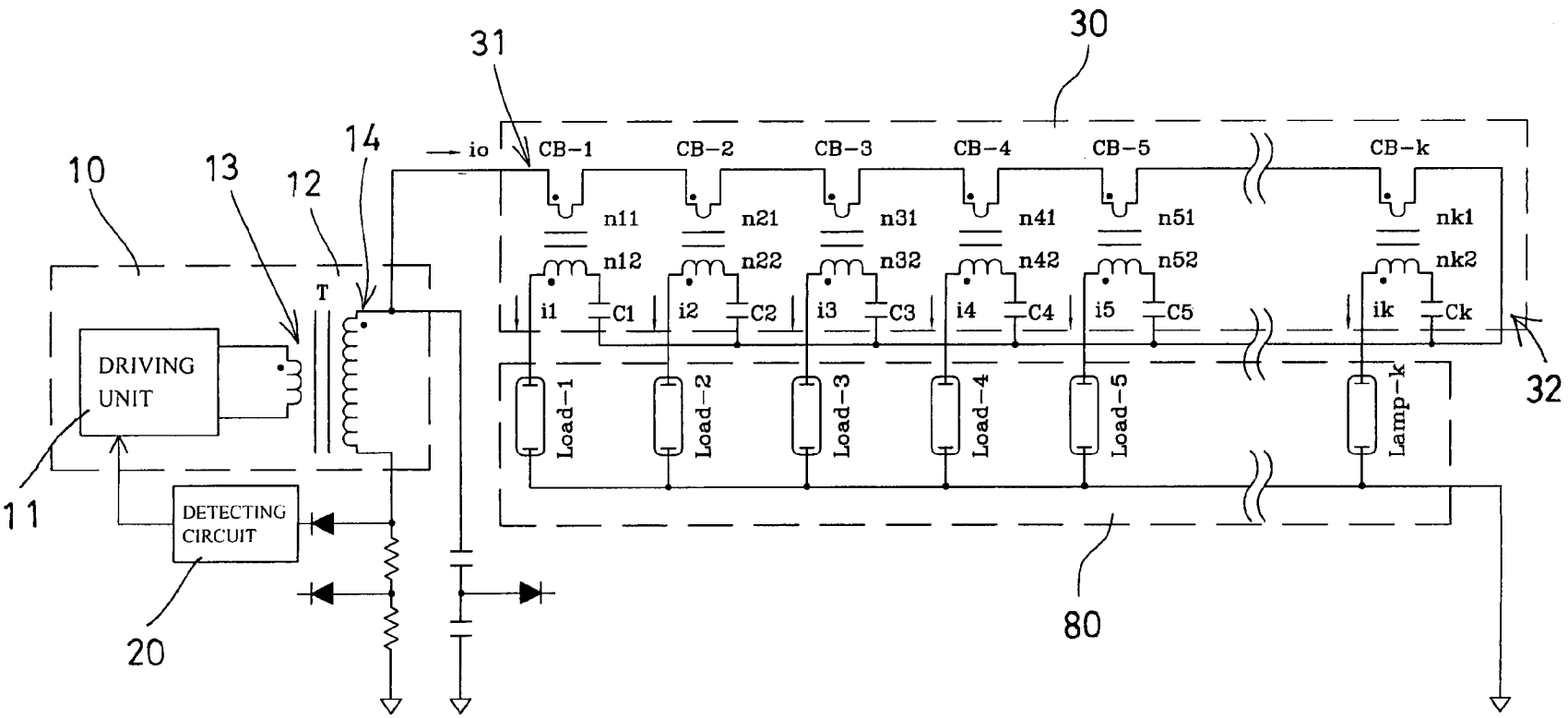
FIG. 6 is a plan schematic view similar to FIGS. 2-5, illustrating a still further application of the electric current balancing device.
Figure 7:
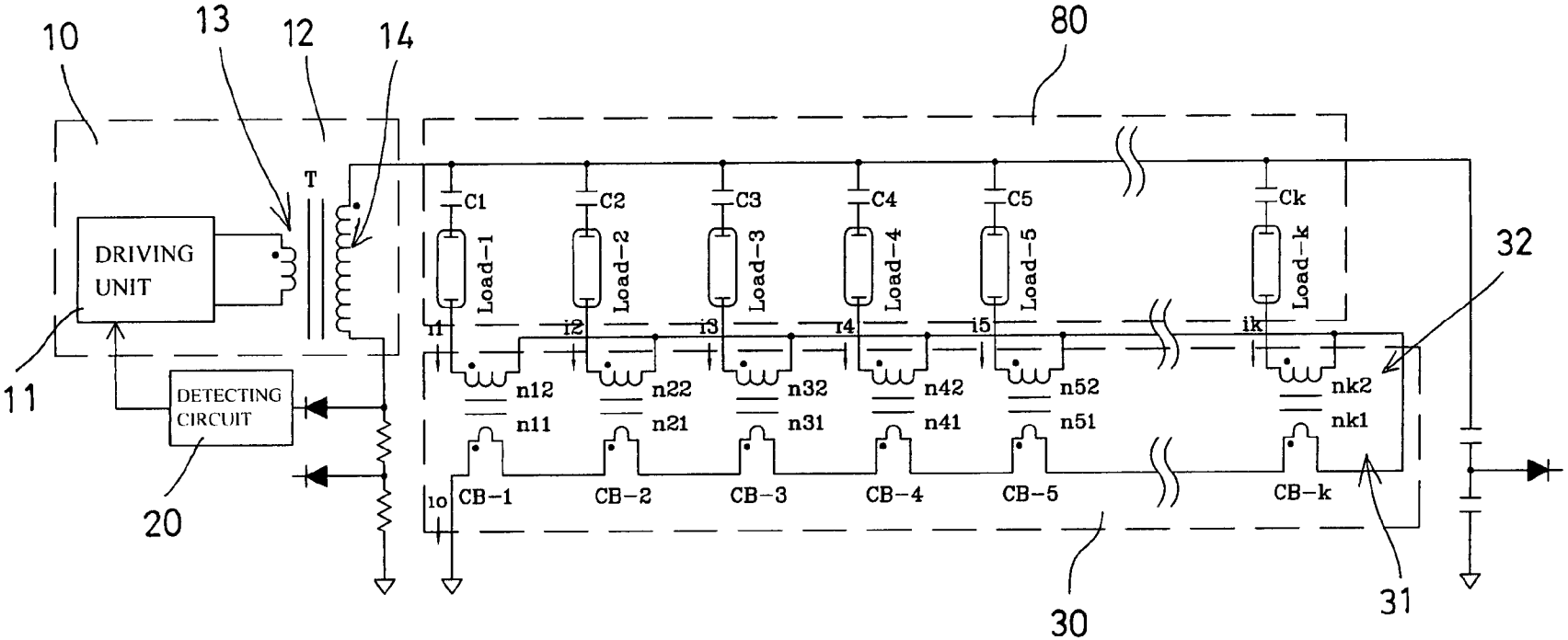
FIG. 7 is a plan schematic view similar to FIGS. 2-6, illustrating a still further application of the electric current balancing device.

In FIGS. 2 and 6, the capacitors Ck are the ballast capacitors for coupling to the load members Loadk of the load device 80 respectively and for sharing and distributing the voltage and for stabilizing the electric current and thus for indirectly driving the load members Loadk of the load device 80 respectively. When the load members Loadk of the load device 80 are arranged to be directly driven by the output of the transformer T or 12 of the inverter circuit 10 and/or the balancing transformer device 30, then the ballast capacitors Ck may be deleted, and then the electric circuits in FIGS. 2 and 6 will be the same or the identical electric circuit.

Figure 3:
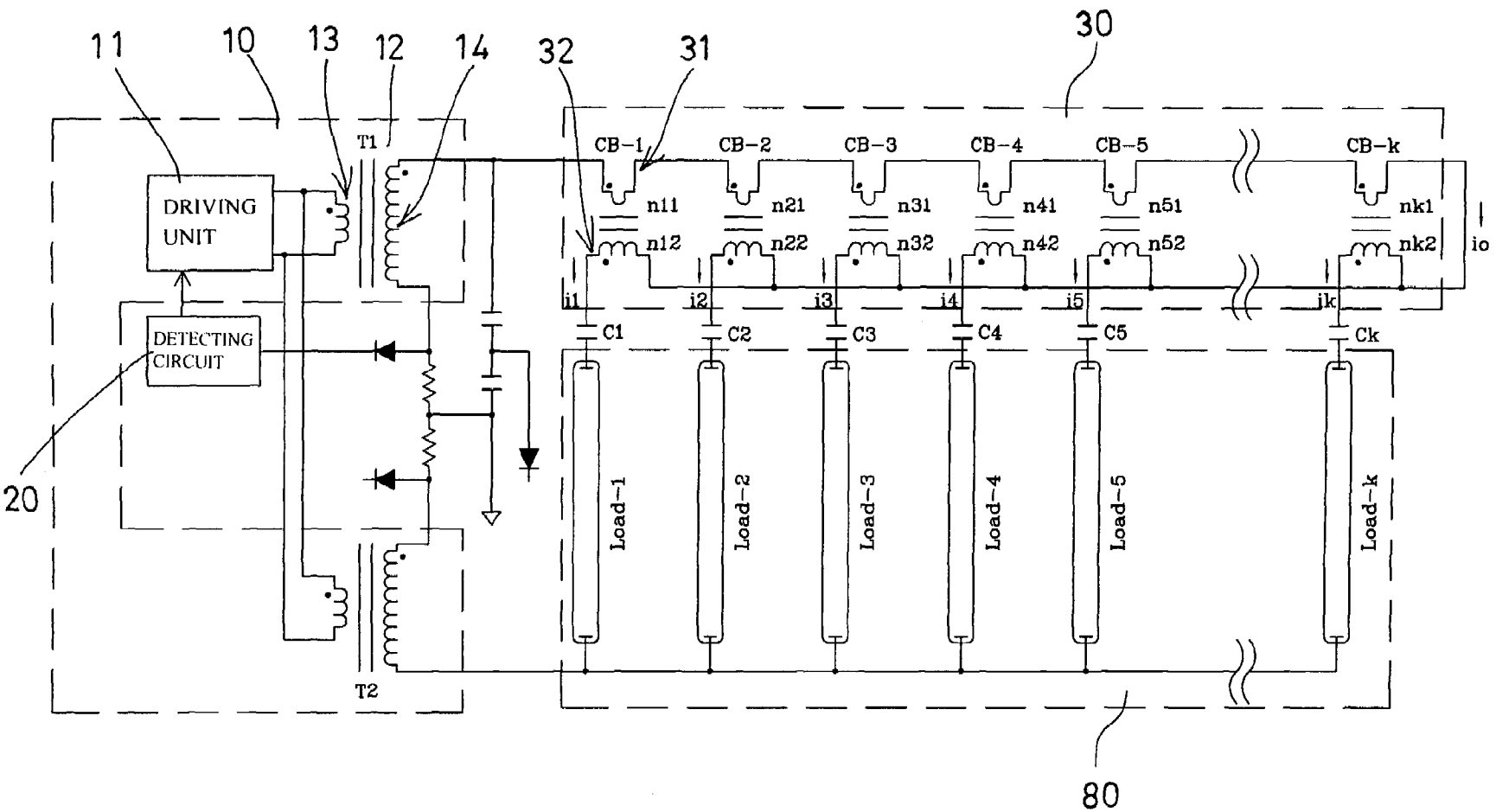
FIG. 3 is a plan schematic view similar to FIG. 2, illustrating another application of the electric current balancing device.

As shown in FIG. 3, when larger or longer lamps or light tubes are used, higher voltage or higher load will be required, and the inverting circuit 10 is required to provide two transformers 12 or T1 and T2 and to couple the two transformers T1 and T2 in series, in order to provide an increased working voltage, and thus to avoid or to prevent the arcing phenomena from being generated. At this moment, the load members Loadk of the load device 80 are floating, and the coupling or connected portion of the two transformers T1 and T2 is grounded, such that the load members Loadk of the load device 80 are also taken as virtual grounding, and such that the voltage for the load members Loadk of the load device 80 will be decreased by one half, and such that the electric current supplied to the load members Loadk of the load device 80 may be suitably controlled and balanced.

Figure 4:
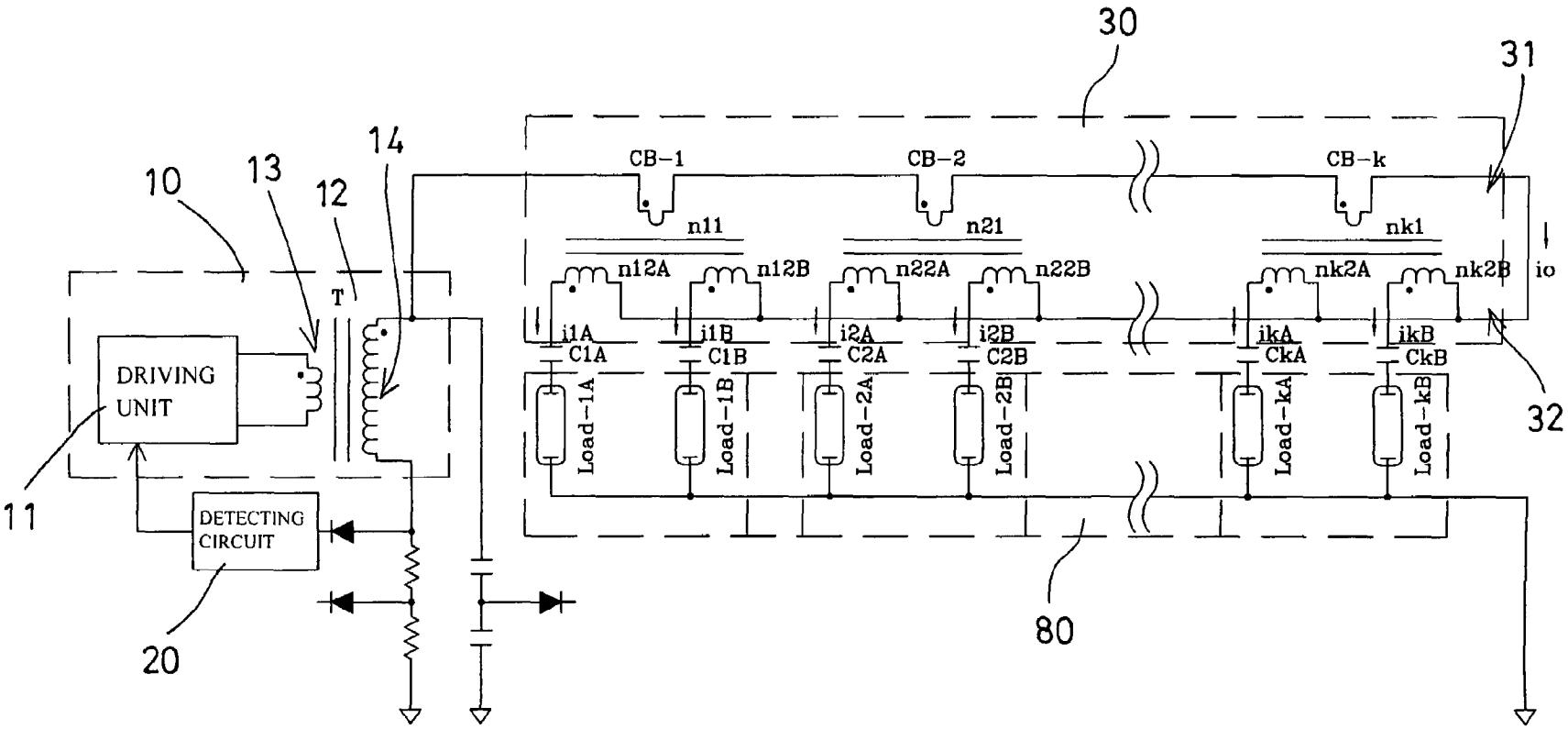
FIG. 4 is a plan schematic view similar to FIGS. 2-3, illustrating a further application of the electric current balancing device.
Figure 5:
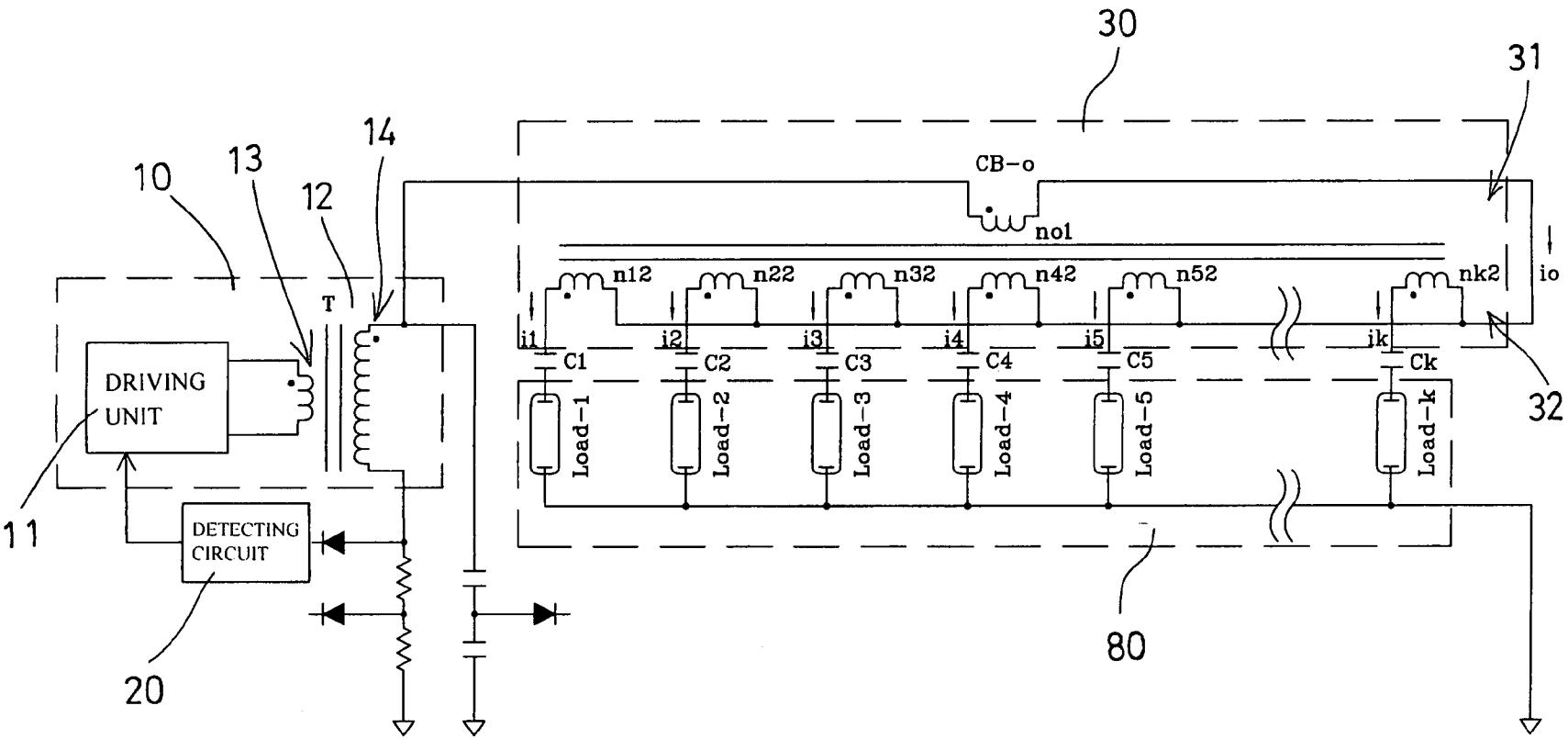
FIG. 5 is a plan schematic view similar to FIGS. 2-4, illustrating a still further application of the electric current balancing device.

As shown in FIGS. 4 and 5, two (FIG. 4) or more load members Loadk (FIG. 5) may be selectively coupled to each of the balancing transformer members CBk of the balancing transformer device 30, for forming a twins structure, a triplet structure or the like, and for allowing the electric current supplied to the load members Loadk of the load device 80 to be suitably controlled and balanced.

Figure 8:
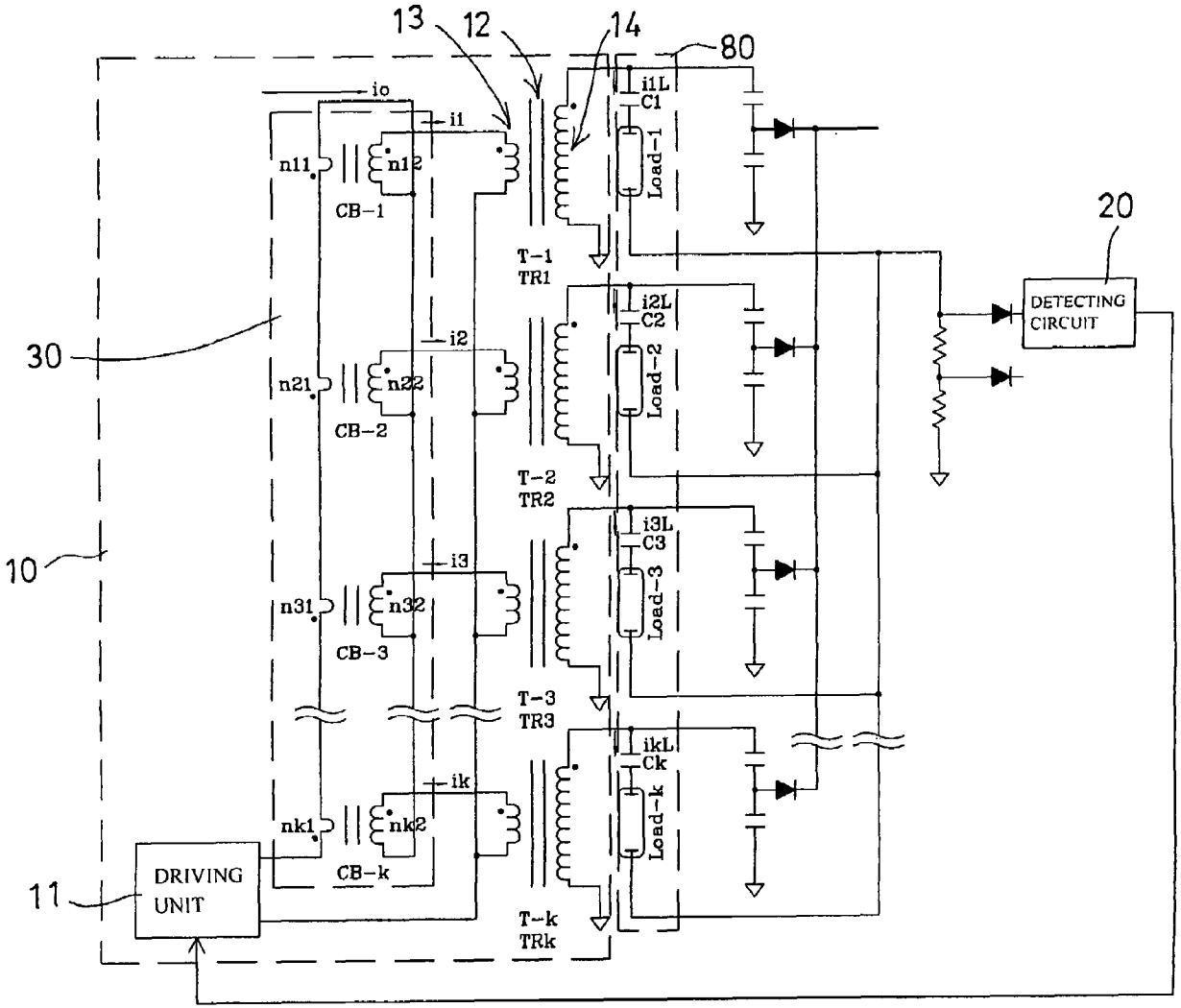
FIG. 8 is a plan schematic view similar to FIGS. 2-7, illustrating a still further application of the electric current balancing device.

As shown in FIG. 8, the balancing transformer device 30 may be coupled to the primary side 13 of the transformer T or 12 of the inverting circuit 10, and may be coupled in seriea to the transformer T or 12 of the inverting circuit 10 and the driving unit 11 of the inverting circuit 10, for allowing the stabilized and balanced electric current supplied from the inverting circuit 10 to evenly flow to the load members Loadk of the load device 80 and to suitably control and balance the load members Loadk of the load device 80.

Figure 9:
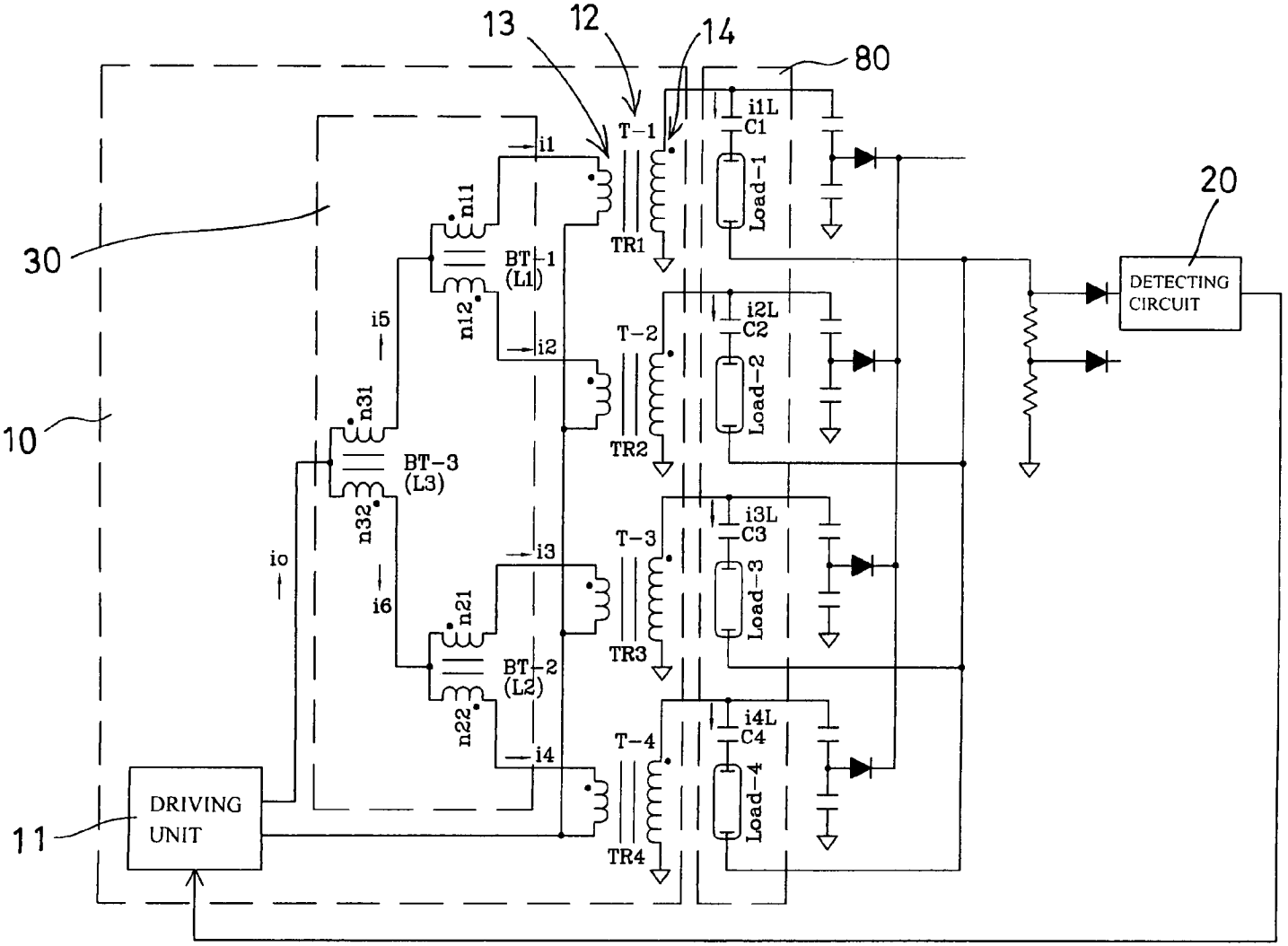
FIG. 9 is a plan schematic view similar to FIGS. 2-8, illustrating a still further application of the electric current balancing device.

As shown in FIG. 9, the balancing transformer device 30 may also be coupled to the primary side 13 of the transformer T or 12 of the inverting circuit 10, and may be coupled in tree type structure to the transformer T or 12 of the inverting circuit 10 and the driving unit 11 of the inverting circuit 10, for allowing the stabilized and balanced electric current supplied from the inverting circuit 10 to evenly flow to the load members Loadk of the load device 80 and to suitably control and balance the load members Loadk of the load device 80.

Figure 10:
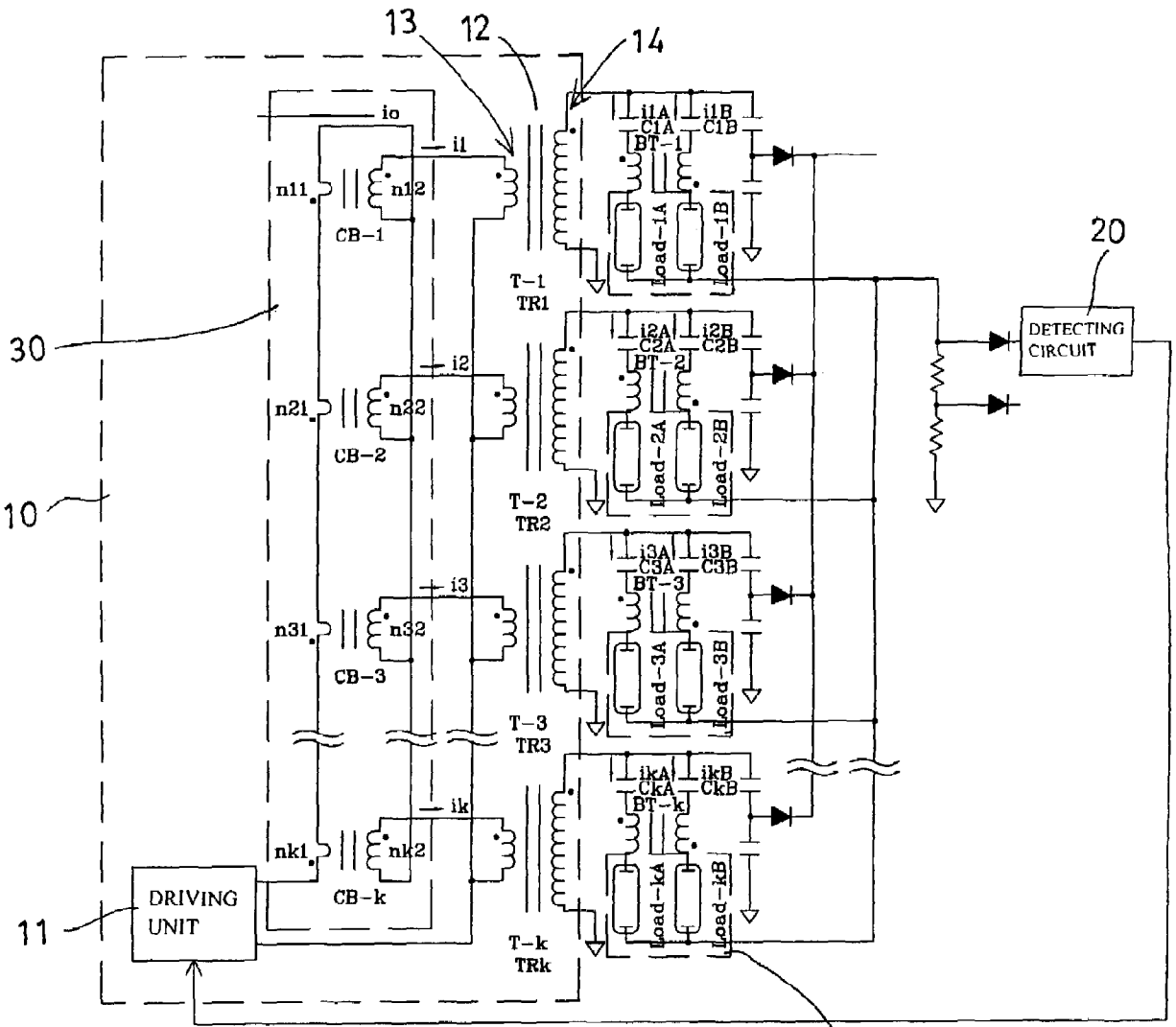
FIG. 10 is a plan schematic view similar to FIGS. 2-9, illustrating a still further application of the electric current balancing device.
Figure 11:
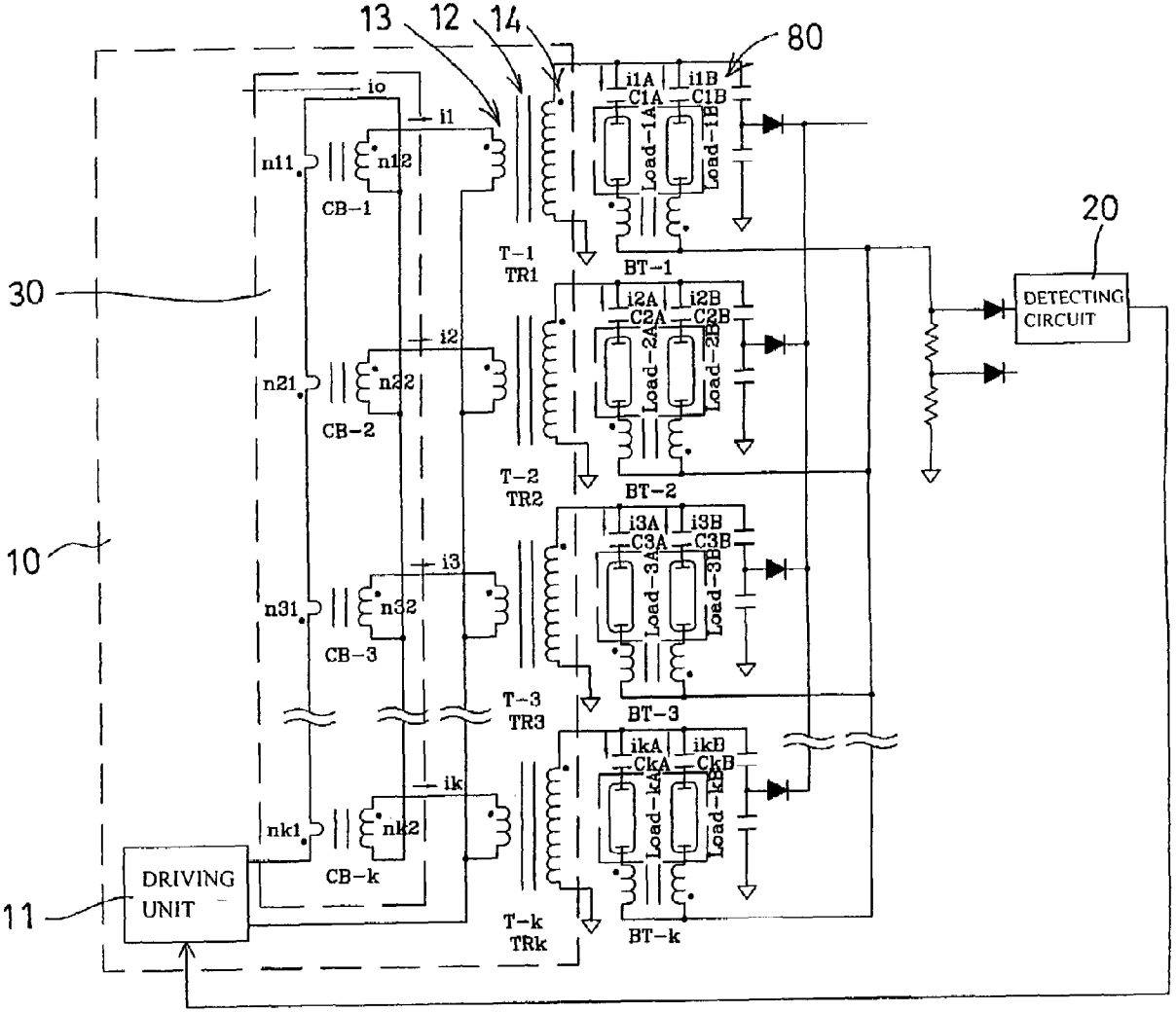
FIG. 11 is a plan schematic view similar to FIGS. 2-10, illustrating a still further application of the electric current balancing device.

As shown in FIGS. 10 and 11, the balancing transformer device 30 may also be coupled to the primary side 13 of the transformer T or 12 of the inverting circuit 10, and may be coupled in series to the transformer T or 12 of the inverting circuit 10 and the driving unit 11 of the inverting circuit 10, and the conventional balancing transformer members TBk may further be provided and coupled to the high voltage side of the load device 80 (FIG. 10) or coupled to the low voltage side of the load device 80 (FIG. 11), for allowing the stabilized and balanced electric current to be supplied from the inverting circuit 10 to evenly flow to the load members Loadk of the load device 80 and to suitably control and balance the load members Loadk of the load device 80.

Figure 12:
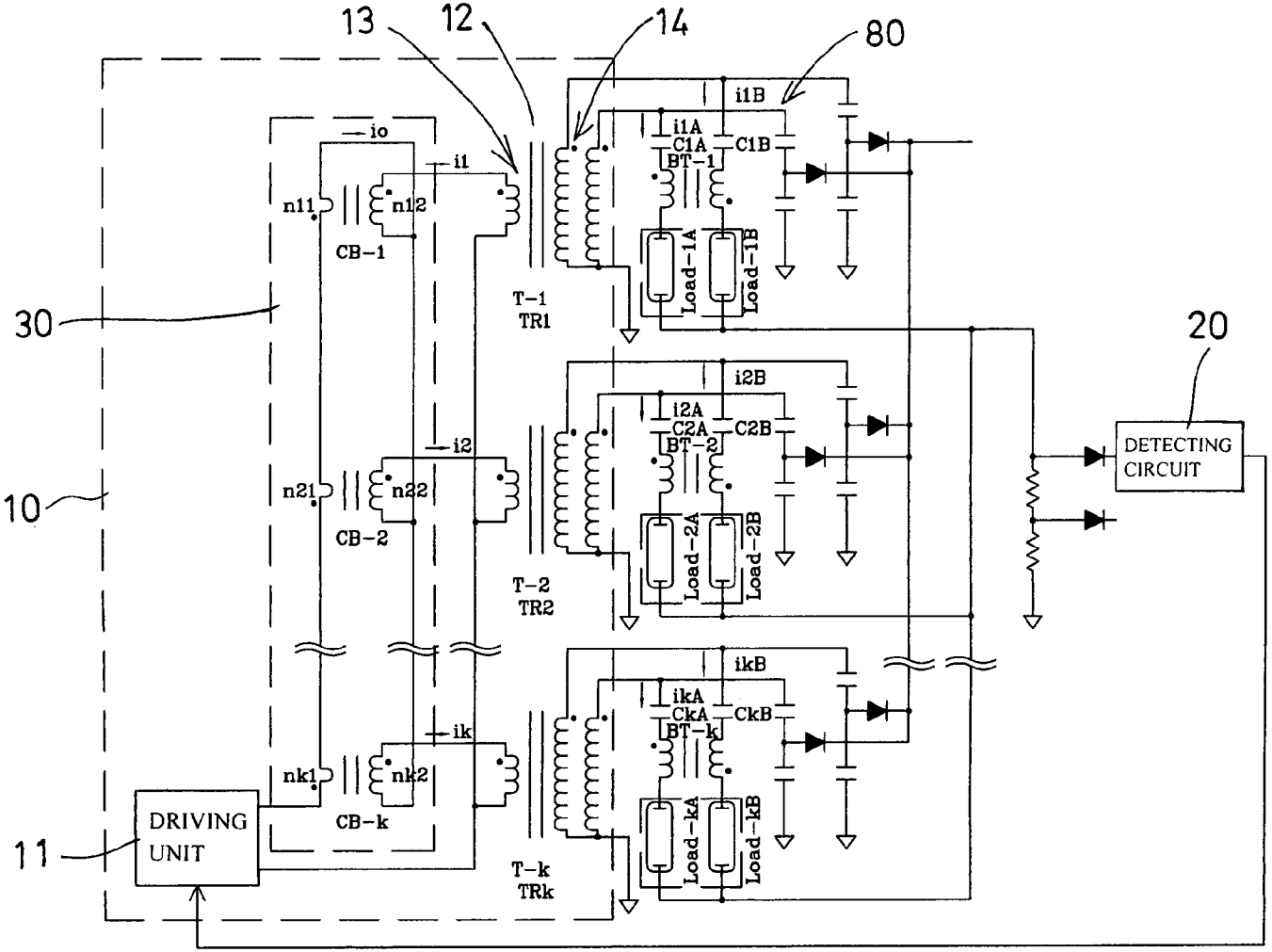
FIG. 12 is a plan schematic view similar to FIGS. 2-11, illustrating a still further application of the electric current balancing device.
Figure 13:
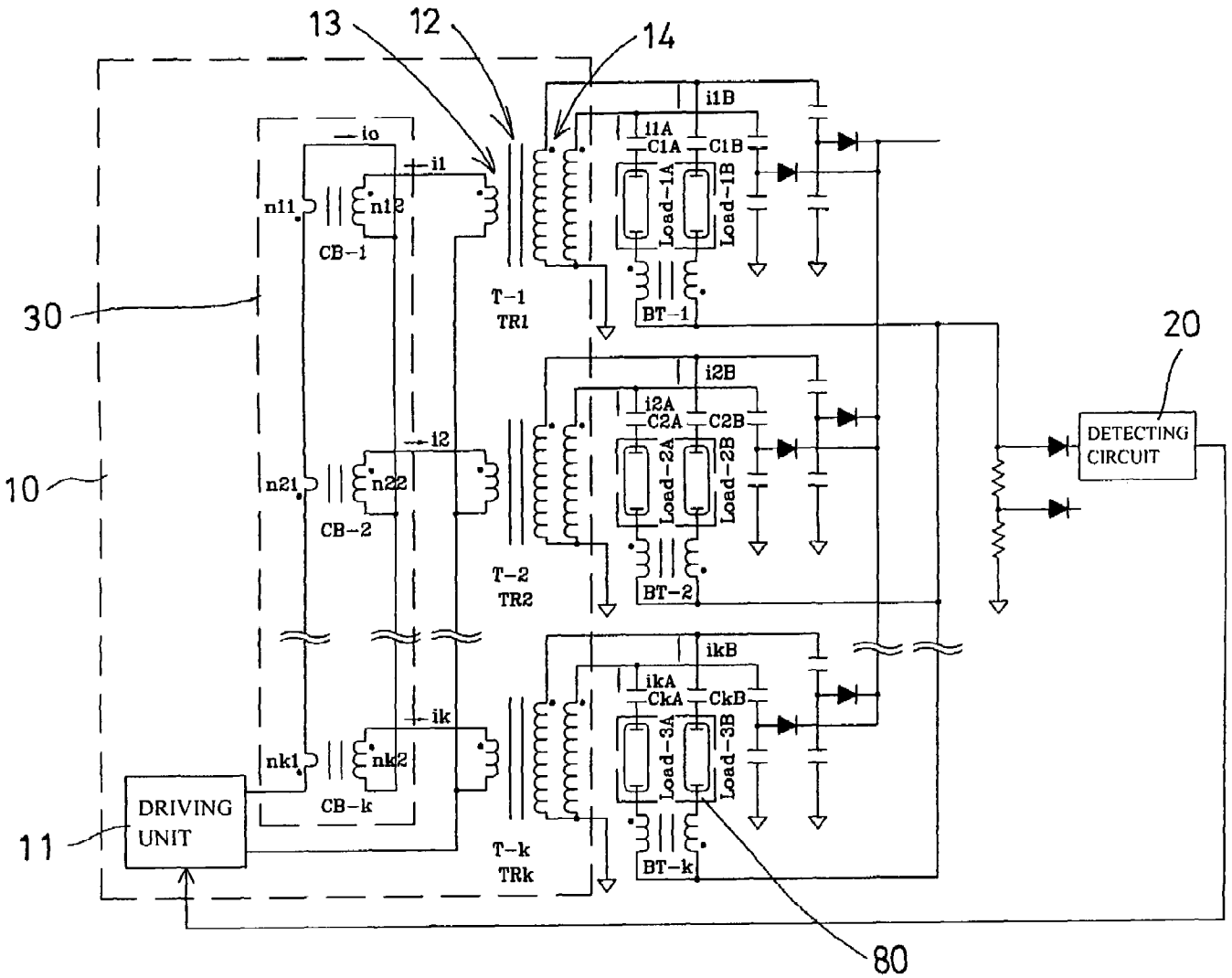
FIG. 13 is a plan schematic view similar to FIGS. 2-12, illustrating a still further application of the electric current balancing device.

As shown in FIGS. 12 and 13, the balancing transformer device 30 may also be coupled to the primary side 13 of the transformer T or 12 of the inverting circuit 10 which includes two secondary windings and output terminals, and the conventional balancing transformer members TBk may further be provided and coupled to the high voltage side of the load device 80 (FIG. 12) or coupled to the low voltage side of the load device 80 (FIG. 13), for allowing the stabilized and balanced electric current supplied from the inverting circuit 10 to evenly flow to the load members Loadk of the load device 80 via the double output terminals of the transformer T or 12 of the inverting circuit 10, and to suitably control and balance the load members Loadk of the load device 80.

Figure 14:
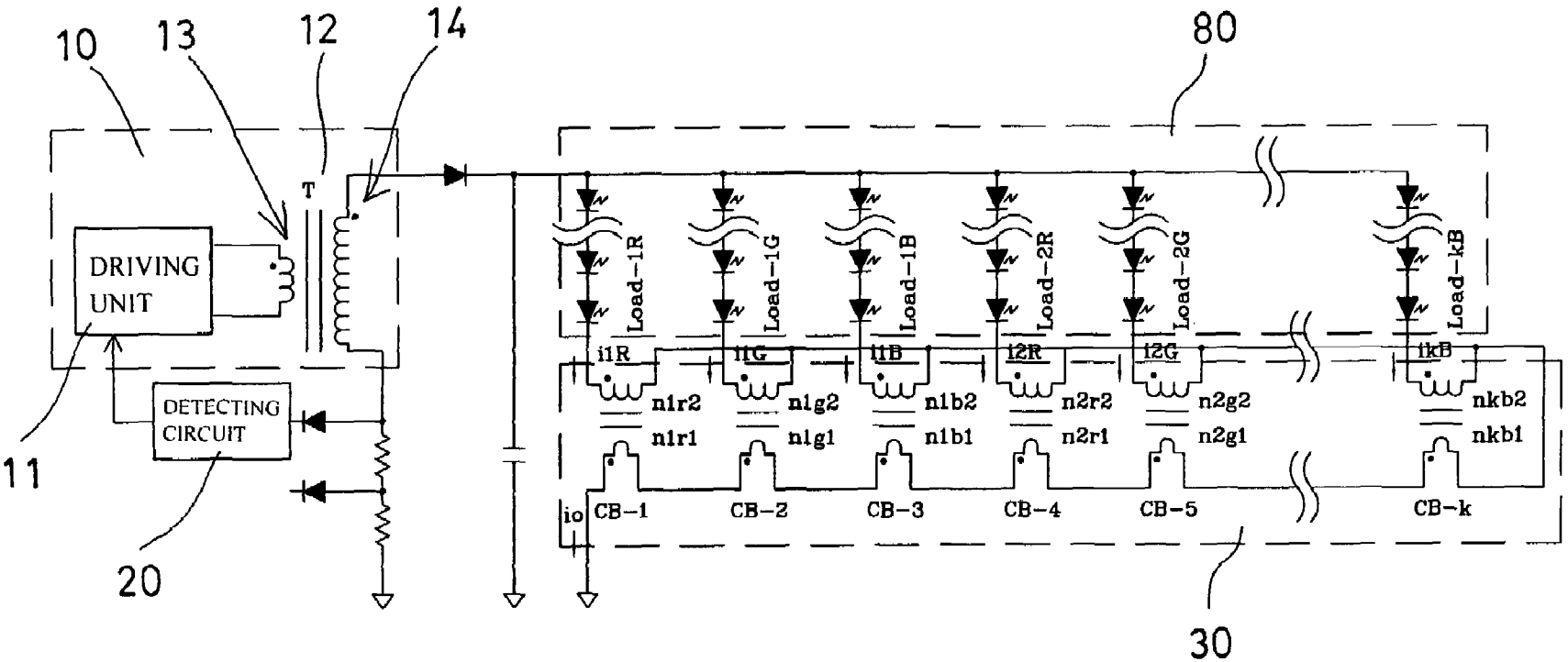
FIG. 14 is a plan schematic view similar to FIGS. 2-13, illustrating a still further application of the electric current balancing device.

As shown in FIG. 14, the load members Loadk of the load device 80 may be the light emitting diodes or the like, the balancing transformer device 30 may be coupled to the secondary side 14 of the transformer T or 12 of the inverting circuit 10, and coupled in parallel to each other and coupled to either the low voltage side or the high voltage side of the load device 80, for allowing the stabilized and balanced electric current supplied from the inverting circuit 10 to evenly flow to the load members Loadk of the load device 80 and to suitably control and balance the load members Loadk of the load device 80, in addition, even when the light emitting diodes or the other lighting members are aged, the turn ratio of the primary side 31 and the secondary side 32 of the balancing transformer device 30 may be regulated for allowing the lighting members of different brightness to generate the required brightness and color rendering or color temperature.

Figure 15:
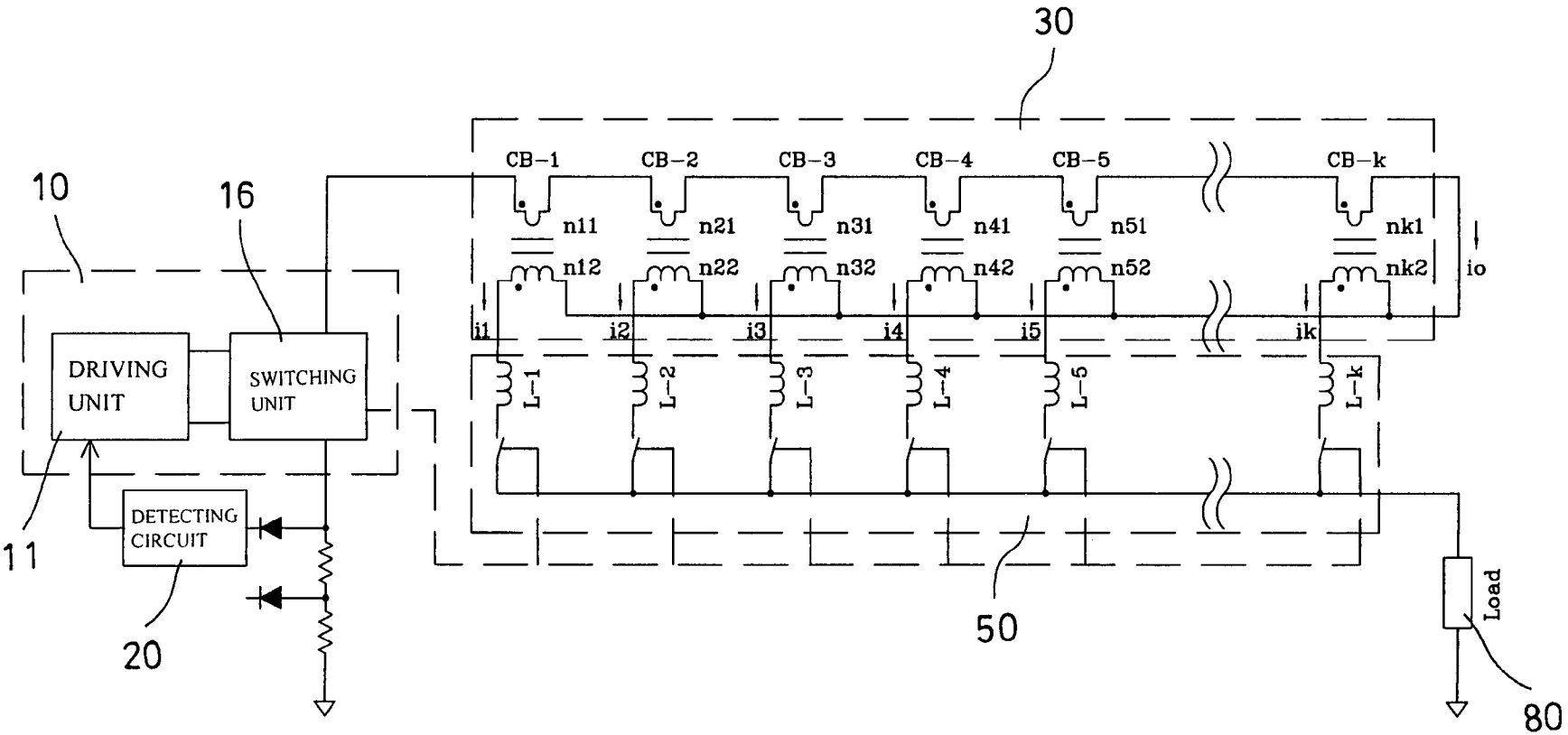
FIG. 15 is a plan schematic view similar to FIGS. 2-14, illustrating a still further application of the electric current balancing device.
Figure 16:
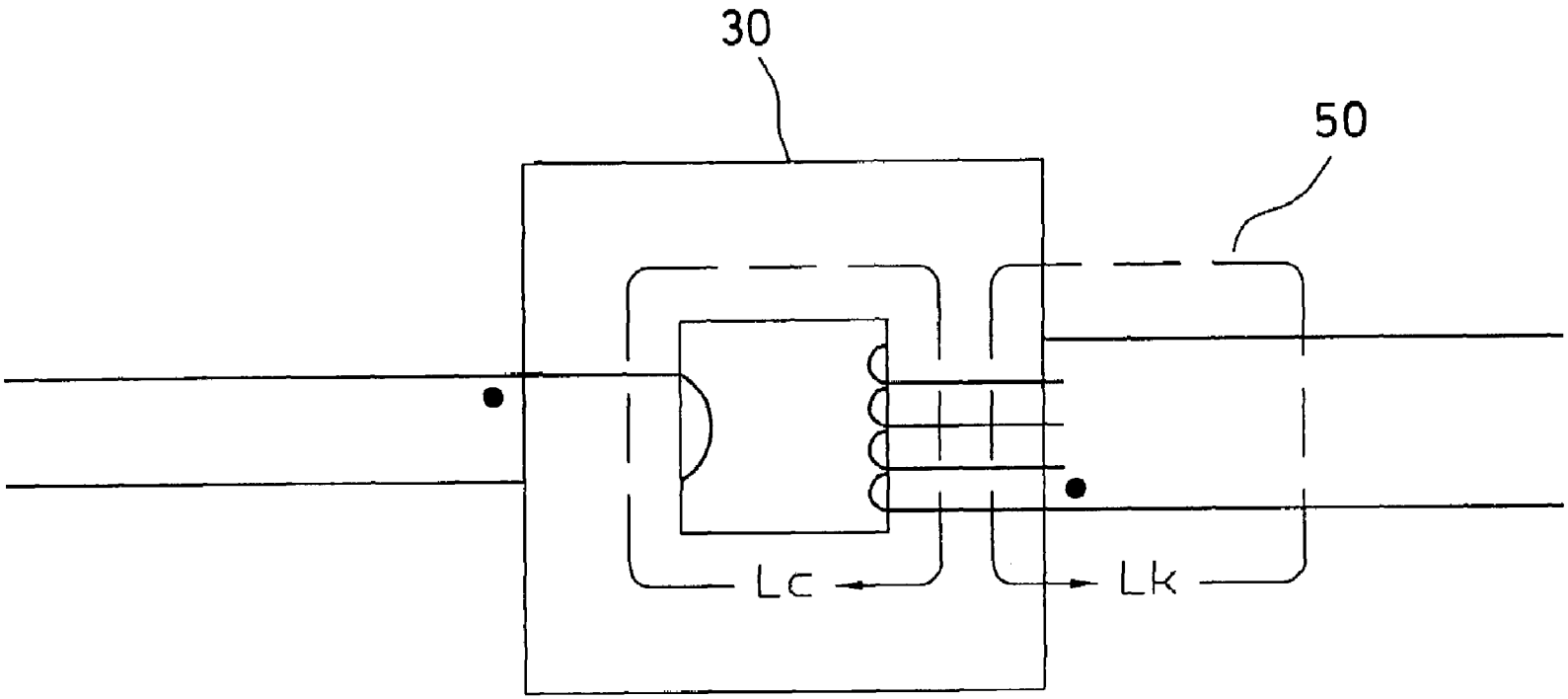
FIG. 16 is a plan schematic view illustrating a general application of the electric circuit of the electric current balancing device as shown in FIG. 15.

As shown in FIGS. 15 and 16, the balancing transformer device 30 may be used or coupled in various single phase, double phase, or multi-phase voltage regulator modules (VRMs), and may be coupled between a switching unit 16 of the inverting circuit 10 and a distributing inductor 50 for allowing the electric current supplied from the inverting circuit 10 to evenly flow to the inductor members Lk of the distributing inductor 50 and thus for allowing the heat source of the whole module to be evenly distributed. As shown in FIG. 16, the balancing transformer device 30 and the distributing inductor 50 may be coupled and constructed together in a dual in one core-and-coil structure, and a differential mode coupling effect Lc between the primary side 31 and the secondary side 32 of the balancing transformer device 30 may be used for balancing the balancing transformer device 30, and the leakage inductance Lk may be applied to and worked as the distributing inductor 50 for evenly or uniformly distributing purposes.

Accordingly, the balancing transformer device 30 may compare the electric current of each of the load members Loadk of the load device 80 with a calibrated and stabilized electric current, in order to suitably control and balance the load members Loadk of the load device 80, and so as to control the driving or energizing or lighting of the load members Loadk of the load device 80. The load members Loadk of the load device 80 may thus be suitably controlled or operated or driven without being affected by the characters of the load members Loadk of the load device 80.

Accordingly, the electric current balancing device in accordance with the present invention may be provided for coupling to a multi-loaded electric facility and for comparing the electric current of each load with a steady and calibrated or regulated or standard electric current, and for providing a stable and balancing electric current to suitably energize the loads of the multi-loaded electric facility.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric current balancing device comprising:

a load device, an inverting circuit including a driving unit and at least one transformer coupled together for outputting an electric current to said load device, a detecting circuit coupled to said inverting circuit, said detecting circuit being provided for receiving and detecting an electric current of said load device and for stabilizing and providing a stabilized and calibrated electric current to said inverting circuit, and a balancing transformer device including a primary side and a secondary side, wherein a first end of said primary side of said balancing transformer coupled to said inverting circuit for receiving the calibrated electric current from said inverting circuit, a second end of said primary side of said balancing transformer coupled to a first end of the secondary side of said balancing transformer and a second end of said secondary side of said balancing transformer coupled to said load device for comparing an electric current of said load device with the calibrated electric current from said inverting circuit and for controlling said load device.

2. The electric current balancing device as claimed in claim 1, wherein said balancing transformer device is selectively coupled between a secondary side of said at least one transformer and said driving unit of said inverting circuit.

3. The electric current balancing device as claimed in claim 1, wherein said balancing transformer device includes at least two coils coupled together at said secondary side of said balancing transformer device.

4. The electric current balancing device as claimed in claim 1, wherein said load device includes at least one light device.

5. The electric current balancing device as claimed in claim 1, wherein said load device is either a single phase, a double phase, or a multi-phase voltage regulator module.

* * * * *